US009523515B2

(12) United States Patent
Park

(10) Patent No.: US 9,523,515 B2
(45) Date of Patent: Dec. 20, 2016

(54) GAS-AIR MIXING DEVICE FOR COMBUSTION APPARATUS

(71) Applicant: KYUNGDONG NAVIEN CO., LTD., Pyeongtaek-si, Gyeonggi-do (KR)

(72) Inventor: Jun Kyu Park, Incheon (KR)

(73) Assignee: KYUNGDONG NAVIEN CO., LTD., Pyeongtaek-si, Gyeonggi-do (KR)

( * ) Notice: Subject to any disclaimer, the term of this patent is extended or adjusted under 35 U.S.C. 154(b) by 184 days.

(21) Appl. No.: 14/378,307

(22) PCT Filed: Mar. 3, 2013

(86) PCT No.: PCT/KR2013/001686

§ 371 (c)(1),
(2) Date: Aug. 12, 2014

(87) PCT Pub. No.: WO2013/133578

PCT Pub. Date: Sep. 12, 2013

(65) Prior Publication Data

US 2015/0000614 A1 Jan. 1, 2015

(30) Foreign Application Priority Data

Mar. 5, 2012 (KR) ..... 10-2012-0022185

(51) Int. Cl.
*F23D 14/62* (2006.01)
*F24H 9/20* (2006.01)
(Continued)

(52) U.S. Cl.
CPC ..... *F24H 9/2035* (2013.01); *F23D 14/60* (2013.01); *F23D 14/62* (2013.01); *F23N 1/02* (2013.01); *F24H 1/186* (2013.01)

(58) Field of Classification Search
CPC ..... F23D 14/62; F23D 14/02; F23D 14/60; F23D 14/70; F23D 11/102; F23D 14/32; F23D 2900/00003; F23N 1/02; F23N 2037/10; F23R 3/286; F24F 13/04
(Continued)

(56) References Cited

U.S. PATENT DOCUMENTS 8,667,912 B2 * 3/2014 Koyama ..... F23D 1/00 110/104 B
8,920,159 B2 * 12/2014 Taylor ..... F23C 9/00 431/181
(Continued)

FOREIGN PATENT DOCUMENTS

EP 0275439 A1 7/1988
JP 53-24141 A1 3/1978
(Continued)

*Primary Examiner* — Gregory A Wilson
(74) *Attorney, Agent, or Firm* — Novick, Kim & Lee, PLLC; Jae Youn Kim

(57) ABSTRACT

Provided is a gas-air mixing device for a combustion apparatus which effectively controls the amount of gas and air supplied to a burner so as to improve the turn-down ratio, thereby improving burner reliability. The gas-air mixing device includes: a housing having one side coupled to a turbo fan; an air supplying unit provided on the other side of the housing, and configured of a first air supply part and a second air supply part; a gas supplying unit configured of a first gas supply part and a second gas supply part; and an opening/closing means which closes the second air supply part and the second gas supply part when a small amount of heat is needed to block the flow of air and gas, and opens the second air supply part and the second gas supply part when a large amount of heat is needed.

7 Claims, 3 Drawing Sheets

(51) Int. Cl.
*F23N 1/02* (2006.01)
*F23D 14/60* (2006.01)
*F24H 1/18* (2006.01)

(58) Field of Classification Search
USPC ..... 122/13.3; 431/354, 89, 175
See application file for complete search history.

(56) References Cited

U.S. PATENT DOCUMENTS 9,134,026 B2 * 9/2015 Blaauwwiekel ..... F23N 1/022
9,182,118 B2 * 11/2015 Akagi ..... F23D 14/58
2006/0292505 A1 * 12/2006 Giacomelli ..... F23N 1/005 431/12
2007/0020575 A1 * 1/2007 Okayasu ..... F23D 14/125 431/354
2011/0139045 A1 * 6/2011 Zatti ..... F23D 14/60 110/188
2012/0135360 A1 * 5/2012 Hannum ..... F23C 99/001 431/350
2013/0011801 A1 * 1/2013 Marutani ..... F23C 6/04 431/354
2014/0080075 A1 * 3/2014 Young ..... F23N 1/022 431/76
2015/0000775 A1 * 1/2015 Min ..... F16K 11/04 137/625.4
2015/0050608 A1 * 2/2015 Min ..... F23D 14/02 431/187

FOREIGN PATENT DOCUMENTS

KR 10-0805630 B1 2/2008
KR 10-2010-0020084 A 2/2010
KR 10-2011-0031003 A 3/2011
KR 10-2012-0109966 A 10/2012

* cited by examiner

GAS-AIR MIXING DEVICE FOR COMBUSTION APPARATUS

TECHNICAL FIELD

The present invention relates to a gas-air mixing device for a combustion apparatus, and particularly to a gas-air mixing device for a combustion device which effectively controls the amount of gas and air supplied to a burner provided in a combustion apparatus, such as a boiler or a hot water heater, thus improving the turn-down ratio which leads to increased convenience for using hot water and heating and enhanced durability of the burner.

BACKGROUND OF THE INVENTION

In general, combustion apparatus used for hot water and heating, such as a boiler or a hot water heater, are classified into an oil boiler, a gas boiler, an electric boiler and a water heater depending on the fuel it is supplied with, and are diversely developed to fit different installation usages.

Among these combustion apparatuses, in particular, the gas boiler and the water heater generally use a Bunsen Burner or a Premixed Burner to combust gas fuel, and among these the combustion method of the premixed burner is carried out by mixing gas and air with mixing ratio of combustion optimum state and supplying this mixture (air+gas) to a burner port for combustion.

The function of a combustion apparatus is evaluated by the turn-down ratio (TDR). A turn-down ratio refers to 'a ratio of maximum gas consumption versus minimum gas consumption' in a gas combustion device in which the gas volume is variable regulated. For instance, if the maximum gas consumption is 24,000 kcal/h and the minimum gas consumption is 8,000 kcal/h, the turn-down ratio is 3:1. The turn-down ratio is controlled according to the ability to maintain a stable flame under minimum gas consumption condition.

In the gas boiler and the water heater, convenience of using hot water and heat increases with larger turn-down ratio. That is, if the turn-down ratio is small (meaning the maximum gas consumption is high) and the burner is activated for a small load volume of the heating water and heat, frequent On/Off of the combustion apparatus occurs, thereby deviation during temperature control increases and durability of the apparatus decreases. Therefore, various methods have been developed to increase the turn-down ratio applied to a combustion apparatus in order to improve aforementioned problems.

Valves which supply gas to these types of burners with proportional control are largely divided into electrical modulating gas valve, which is controlled by current value, and pneumatic modulating gas valve, which is controlled by differential pressure generated during air supply.

In the pneumatic modulating gas valve, the amount of gas supplied to the burner is controlled using a fan by differential pressure generated according to air supply needed for combustion in the burner. At this time, the air and gas needed for combustion are mixed in the gas-air mixer and supplied to the burner as a mixture (air+gas).

In a gas-air mixing device of a gas burner using such pneumatic modulating gas valve, the primary factor controlling the turn-down ration is the relationship between gas consumption (Q) and differential pressure (ΔP). The common relationship between fluid pressure and flow rate is as follows:

$$Q=k\sqrt{\Delta P}$$

That is, differential pressure needs to be quadrupled in order to double fluid flow rate.

Therefore, differential pressure ratio must be 9:1 in order to have a turn-down ratio of 3:1, and the differential pressure ratio needs to be 100:1 to have a turn-down ratio of 10:1. However, it is impossible to infinitely increase the gas feed pressure.

In order to solve the above problem, the present invention describes, as illustrated in FIG. 1, a method for increasing the turn-down ratio of the gas burner by dividing the gas and air supply paths into more than two sections, respectively, and opening/closing each passage of gas injected into the burner.

PRIOR ART

Patent Literature (Patent Literature 1) Korean Patent Application No. 10-2011-84417

DISCLOSURE OF INVENTION

Technical Problem

The aforementioned patent literature is a previously filed application by the applicant of the present invention and is directed to a gas-air mixing device for a combustion apparatus with branched flow passages. Referring to FIG. 1 a gas supply pipe (112) that is divided into two parts is connected to one side of an air supply pipe (113), and a separate branching mechanism (170) is provided inside the air supply pipe (113). As a result, valve bodies (161, 162) connected to a rod (163) open and close a gas flow passage (116) and an air flow passage (118) via the up and down motion of the rod (163) connected to an electromagnet (165), through which the boiler can be controlled with low output mode and high output mode, to improve the turn-down ratio.

However, in the air flow passage (118), a cylindrically shaped passage is partitioned by the branching mechanism (170) to control air inflow in two steps. Thus, it is impossible to expand the air flow passage (118) when a larger air inflow is needed, and as a result high turn-down ratio cannot be realized.

Further, the long up and down motion range of the rod (163) increases stroke, resulting in increased operating time and operating distance.

The present invention has been made to solve the above-described problem occurring in the prior art, and an object of the present invention is to provide a gas-air mixing device for a combustion apparatus with excellent performance and inexpensive manufacturing cost, having a separate opening/closing means for controlling the amount of air and gas flowing into a burner, such as a boiler or a hot water heater, through which the amount of air and gas can be controlled to increase the turn-down ratio. Further, short stroke in a solenoid valve is overcome using principle of a lever and a hinge, such that an actuator can be used to apply a solenoid valve with very short operating time and excellent durability.

Technical Solution

The present invention, which aims to solve the above-described problem comprises, a housing connected on one side to a turbo fan and is provided with a predetermined space in the interior thereof through which gas and air can flow, but which is divided into a first passage and a second passage; a first air supply part and a first gas supply part each connected to the first passage through mutually different pathways; a second air supply part and a second gas supply part each connected to the second passage through mutually different pathways; and an opening/closing means which blocks the flow of air and gas supplied to the second air supply part and the second gas supply part at low-output mode, and opens the second air supply part and the second gas supply part at high-output mode.

In one embodiment, the opening/closing means comprises a hinge provided inside the second flow passage; a rotor that is connected to the hinge, with both ends thereof respectively connected to a first valve body and a second valve body, to open and close the second air supply part and a second gas supply part provided in the second flow passage; a plunger connected at the rotor between the first valve body or the second valve body and the hinge; and a solenoid valve connected to the plunger and controlling the up and down motion of the plunger through an electrical signal. The rotor is actuated to rotate around the hinge according to the principle of a lever, thus allowing the plunger to open and close the second air and gas supply parts with short stroke.

In one embodiment, the opening/closing means is characterized by simultaneously achieving closing or opening of the second air supply part and the second gas supply part.

In one embodiment, the first and second flow passages are characterized by having different diameters.

In one embodiment, the first and second flow passages are characterized by having a larger diameter of the second flow passage compared to the first flow passage.

Advantageous Effects

Using the gas-air mixing device for a combustion apparatus according to the present invention, first, manufacturing cost is decreased by opening or closing the flow of gas and air using a solenoid valve.

Second, in general, approximately a tenfold amount of air is necessary to combust a predetermined quantity of fuel. Thus, sufficient amount of open cross-sectional areas during operation of the second air supply part is required for efficient air supply during high-output mode. For this purpose, short stroke of the solenoid valve is overcome using principles of the lever and hinge, thereby a solenoid valve with very short operating time and excellent durability can be used.

Third, the flow passage through which the first gas and air flow into and the flow passage through which the second gas and air flow into are divided. Thus, inflow of gas and air is effectively controlled and heat power needed at the combustion apparatus can be adequately controlled.

Fourth, the flow passages are divided into two, but different diameters can be set for the flow passages according to the capacity of the combustion apparatus, thereby the turn-down ratio is increased.

Fifth, gas and air flowing into the second side is simultaneously closed or opened to reduce stroke, thereby preventing unnecessary use of power.

DESCRIPTION OF THE PREFERRED EMBODIMENTS

Figure 1:
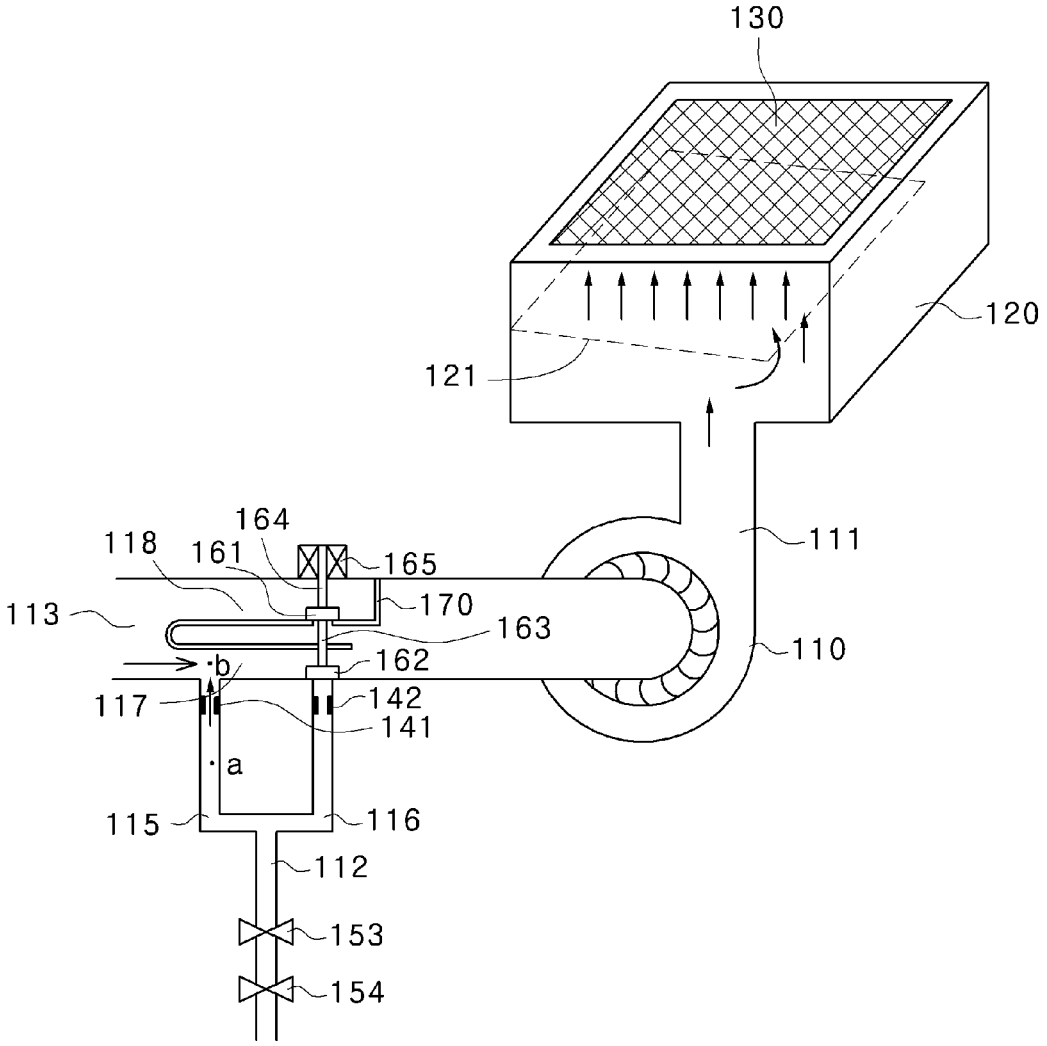
FIG. 1 PRIOR ART
FIG. 1 is a graph showing prior art.

Hereinafter, exemplary embodiment of the present invention will be described with reference to the accompanying drawings. The embodiment of the present invention can be modified into various forms, and it should be understood that the scope of present invention is not limited to the embodiment whose detailed description is provided below. The following embodiment is given to provide a more detailed description of the preset invention to those skilled in the art. Therefore, shapes of the elements may be exaggerated in the drawings for a clearer understanding of the description. Identical or corresponding elements in each drawing may be designated with same reference signs. In addition, description of known functions or configurations determined to hinder understanding of the present invention are omitted.

Hereafter, an exemplary embodiment of the gas-air mixing device for a combustion apparatus of the present invention will be described in detail with reference to the accompanying drawings.

Figure 2:
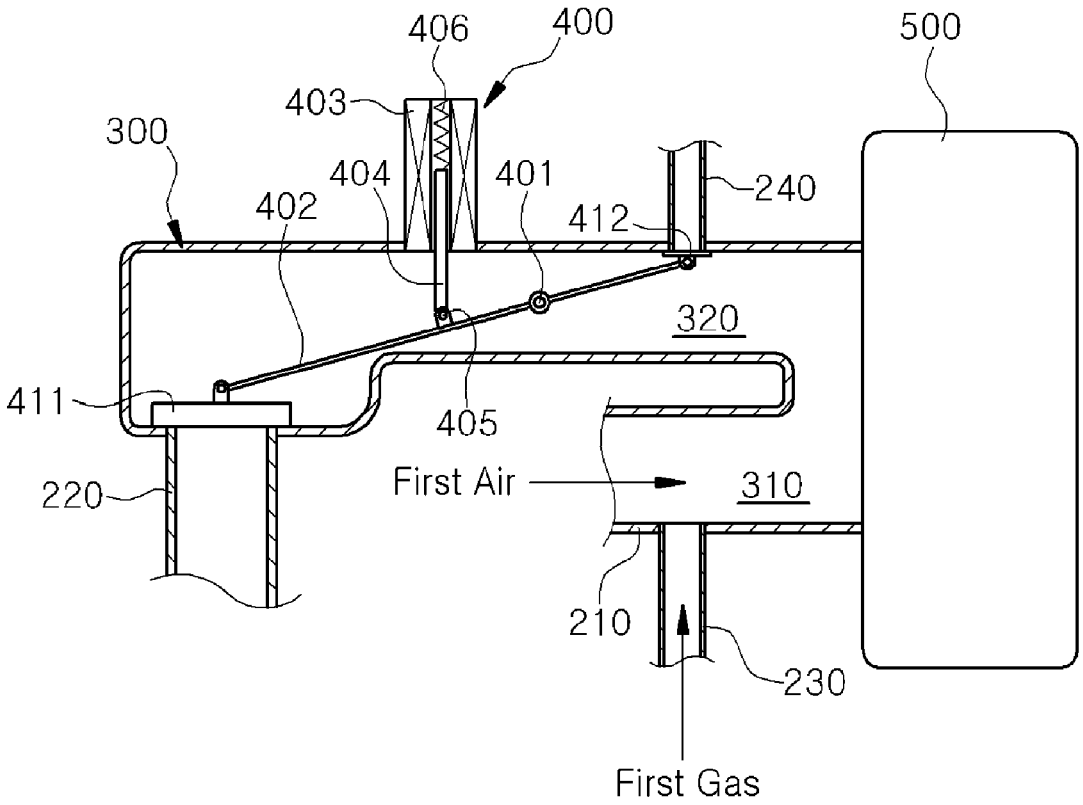
FIG. 2 is a schematic view of the gas-air mixing device for a combustion apparatus according to the present invention.
Figure 3:
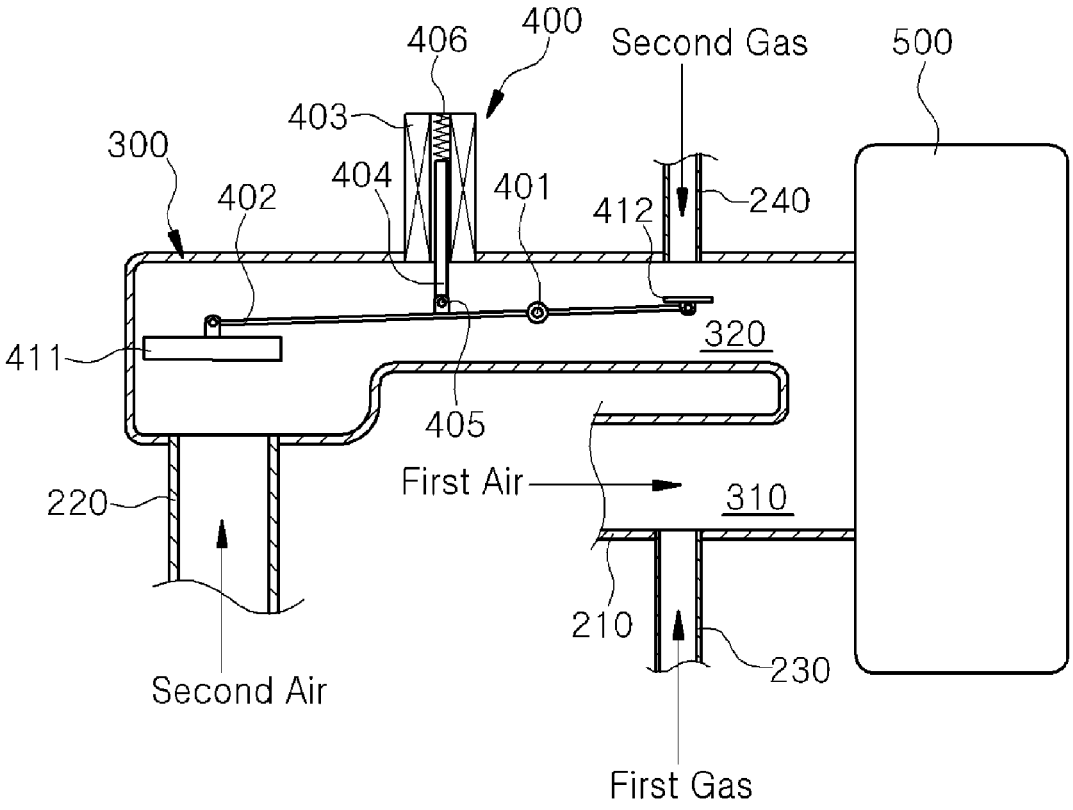
FIG. 3 is a mimetic view schematically showing the operating state of FIG. 2.

In the accompanying drawings, FIG. 2 is a schematic view of the gas-air mixing device for a combustion apparatus according to the present invention, and FIG. 3 is a mimetic view schematically showing the operating state of FIG. 2.

Referring to FIG. 2 and FIG. 3, the gas-air mixing device for a combustion apparatus of the present invention is provided with a housing (300) having a predetermined space in which air and gas to be supplied to the burner (not shown) via a turbo fan (500) is mixed to produce mixed gas. The housing (300) is divided into a first flow passage (310) and a second flow passage (320), and the outlet through which gas and air are mixed and discharged, is connected to the turbo fan (500).

The first flow passage (310) is provided with a first air supply part (210) and a first gas supply part (230) each connected through mutually different pathways. The first air supply part (210) and the first gas supply part (230) are always maintained in an open state, as pathways for gas and air to flow through, when the combustion apparatus is actuated at low-output mode.

The second flow passage (320) is also provided with a second air supply part (220) and a second gas supply part (240) each connected through mutually different pathways, similar to the first flow passage (310). The second air supply part (220) and the second gas supply part (240), as pathways for gas and air to flow through, are closed by the opening/closing means (400) to be described hereafter when the combustion apparatus is actuated at high-output mode.

Hereafter, the aforementioned opening/closing means (400) will be described in detail.

The opening/closing means (400) comprises a hinge (401) provided in the second flow passage (320), and a rotor (402) connected to the hinge (401) with both ends thereof respectively connected to a first valve body (411) and a second valve body (412), to open and close the second air supply part (220) and a second gas supply part (240) provided in the second flow passage (320).

One end of a plunger (404) is connected to a part of the rotor (402) by a hinge (405), allowing easy rotation by the hinge (405) during up and down motion of the plunger (404). The other end of the plunger (404) is connected to a solenoid valve (403) which controls the up and down motion of the plunger (404) using electrical signal.

Therefore, the plunger (404) moves up and down according to the electrical signal transmitted to the solenoid valve (403). More specifically, as shown in FIG. 3, the first valve body (411) closing the second air supply part (220) and the second valve body (412) closing the second gas supply part (240) are released when the plunger (404) ascends, resulting in inflow of gas and air to the second flow passage (320).

That is, the rotor (402) of the opening/closing means (400) described above functions as a lever. Thus, the longer part of the rotor (402) is positioned with the second air supply part (220) and the short part is positioned with the second gas supply part (240) using the hinge (401) as the fulcrum, to supply larger amount of air when the combustion apparatus switches to high-output mode. Therefore, the opening/closing means (400) functions as a valve since it can simultaneously open and close the second air and gas supply parts (220, 240).

Meanwhile, the first flow passage (310) and the second flow passage (320) have diameters different from each other. Regarding the first and second flow passages (310, 320), it is preferable to have a larger diameter of the second flow passage (320) compared to the first flow passage (310), to increase the turn-down ratio.

For instance, the ratio of the diameters of the first flow passage (310) and the second flow passage (320) can be set 5:5. However, the turn-down ratio can be increased if the diameter of the first flow passage (310) is larger than the diameter of the second flow passage (320).

Hereafter, operating state of the gas-air mixing device for a combustion apparatus of the present invention configured as above will be described in detail.

As illustrated in FIG. 2, during low-output mode, the plunger (404) of the opening/closing means (400) is in a descended state, resulting in gas and air to be blocked by blocking inlets of the second air supply part (220) and the second gas supply part (240) via the first valve body (411) and the second valve body (412). Thus, the first air and gas are transmitted to the turbo fan (500) by flowing into the first flow passage (310) through only the first air supply part (210) and the first gas supply part (230), thereby the combustion apparatus is actuated at low-output mode.

Subsequently, when the combustion apparatus switches to a high output mode, electrical signal is supplied to the solenoid valve (403) and as a result the plunger (404) ascends to the upper portion. This causes the rotor to be rotated by the hinge (401), which releases the first valve body (411) and the second valve body (412) respectively blocking the second air supply part (220) and the second gas supply part (240), thereby the second air and gas flow into the second flow passage to be mixed.

If the mode is switched back to the low output mode later on, when the power supply to the solenoid valve (403) is blocked, the plunger (404) descends due to the weights of the rotor (402) and the valve bodies (411, 412) and the elasticity of the spring (406) provided inside the solenoid valve (403). Consequently, the first valve body (411) and the second valve body (412) close the inlets of the second air supply part (220) and the second gas supply part (240) to block the second air and gas.

Therefore, opening and closing of the second air and gas supply parts (220, 240) can be controlled by the aforementioned solenoid valve (403), and thereby easily control the heating power output at the combustion apparatus. Further, the up and down motion of the plunger (404) is controlled by the solenoid valve (403), which has a very short actuating time compared to the method of controlling the gas and air passages using existing motors, thus controlling inflow and blocking of the air and gas is convenient and the performance of the combustion apparatus can be improved.

In addition, the turn-down ratio can be increased since the flow passage of the housing (300) is divided into two. For instance, the turn-down ratio will be increase when the diameter of the first flow passage (310) is larger than the second flow passage (320). Accordingly, by having a long length of the inlet of the rotor (402), through which the second air flows, same stroke can be used to control opening/closing of the gas and air inflow.

The above description relating to a preferred embodiment of a dual venturi for a hot water heater according to the present invention is merely an example. It will be understood by the skilled person in the art that various modifications and other similar embodiments based on the description provided can be made. Therefore, it is clear that the present invention is not limited to the referred embodiment described above. Accordingly, the scope of the invention to be protected must be based on the technical principles of the accompanying claims. Further, it must be understood that various modifications, additions and substitutions are possible, without departing from the scope and spirit of the invention as disclosed in the accompanying claims.

REFERENCE SIGNS

210: First Air Supply Part 220: Second Air Supply Part
230: First Gas Supply Part 240: Second Gas Supply Part
300: Housing 400: Opening/Closing Means
401, 405: Hinge 402: Rotor
403: Solenoid Valve 404: Plunger
411: First Valve Body 412: Second Valve Body
500: Turbo Fan

The invention claimed is:

1. An air and gas mixing device for a combustion apparatus, the air and gas mixing device comprising:

a housing connected on one side to a turbo fan and defining a predetermined space in an interior thereof through which gas and air can flow, the predetermined space being divided into a first flow passage and a second flow passage;

a first air supply part and a first gas supply part connected to the first flow passage through mutually different pathways, respectively;

a second air supply part and a second gas supply part connected to the second flow passage through mutually different pathways, respectively; and an opening/closing valve assembly including a first valve body, a second valve body, and a rotor having both ends thereof respectively connected to the first valve body and the second valve body, wherein the first valve body and the second valve body are configured to open and close the second air supply part and the second gas supply part located in the second flow passage, respectively, for blocking a flow of gas and air to the second air supply part and the second gas supply part in a low-output mode, and for opening the second air supply part and the second gas supply part in a high-output mode.

2. The air and gas mixing device as claimed in claim 1, the opening/closing valve assembly comprises:

a hinge disposed inside the second flow passage, wherein the rotor is connected to the hinge;

a plunger connected at the rotor between the first valve body or the second valve body and the hinge; and a solenoid valve connected to the plunger and controlling a up and down motion of the plunger through an electrical signal, wherein the rotor is actuated to rotate around the hinge, thereby the plunger opening and closing the second air and gas supply parts with a short stroke.

3. The air and gas mixing device as claimed in claim 2, the opening/closing valve assembly is configured to simultaneously close or open the second air supply part and the second gas supply part.

4. The air and gas mixing device as claimed in claim 2, the first and second flow passages have different diameters from each other.

5. The air and gas mixing device as claimed in claim 1, the opening/closing valve assembly is configured to simultaneously close or open the second air supply part and the second gas supply part.

6. The air and gas mixing device as claimed in claim 1, the first and second flow passages have different diameters from each other.

7. The air and gas mixing device as claimed in claim 6, the second flow passage has a larger diameter than that of the first flow passage.

* * * * *